US005335472A

United States Patent [19]

Phillips

[11] Patent Number: 5,335,472

[45] Date of Patent: Aug. 9, 1994

[54] CONCRETE WALLS FOR BUILDINGS AND METHOD OF FORMING

[76] Inventor: Charles N. Phillips, 8135 Jackrabbit Rd., Houston, Tex. 77095

[21] Appl. No.: 983,305

[22] Filed: Nov. 30, 1992

[51] Int. Cl.[5] ..... E04C 3/30

[52] U.S. Cl. ..... 52/743; 52/745.1; 52/823; 52/309.12; 52/259

[58] Field of Search ..... 52/309.12, 309.14, 309.17, 52/293.3, 295, 259, 581, 823, 743, 745.1, 745.13, 656.1, 656.2

[56] References Cited

U.S. PATENT DOCUMENTS

| | | | |
|---|---|---|---|
| 3,826,052 | 7/1974 | Tenorio | 52/309.12 X |
| 3,950,902 | 4/1976 | Stout | 52/295 X |
| 4,454,702 | 6/1984 | Bonilla-Lugo et al. | 52/309.12 X |
| 4,669,240 | 6/1987 | Amormino | 52/309.12 X |
| 4,674,242 | 6/1987 | Oboler et al. | 52/309.12 X |
| 4,970,838 | 11/1990 | Phillips | 52/309.14 X |
| 5,033,248 | 7/1991 | Phillips . | |
| 5,038,541 | 8/1991 | Gibbar, Jr. | 52/309.12 X |

*Primary Examiner*—Carl D. Friedman
*Assistant Examiner*—Lan C. Mai
*Attorney, Agent, or Firm*—Bush, Moseley & Riddle

[57] ABSTRACT

A reinforced concrete building (10) has vertical walls (16) formed of prefabricated modules (24) which may be assembled offsite and then transported to the construction site for installation and application of concrete. The prefabricated modules (24) are supported between lower and upper channel-shaped support members (30, 40) and are spaced from each other a sufficient distance for a concrete column (54) therebetween. A backing member (50) is secured between adjacent modules (24) and vertical reinforcing rods (42) are provided adjacent backing member (50) in the space between the modules (24) for the concrete columns (54). Concrete is applied pneumatically against the backing member (50) to fill the space between the modules (24) to form the concrete column (54).

16 Claims, 6 Drawing Sheets

FIG. 1
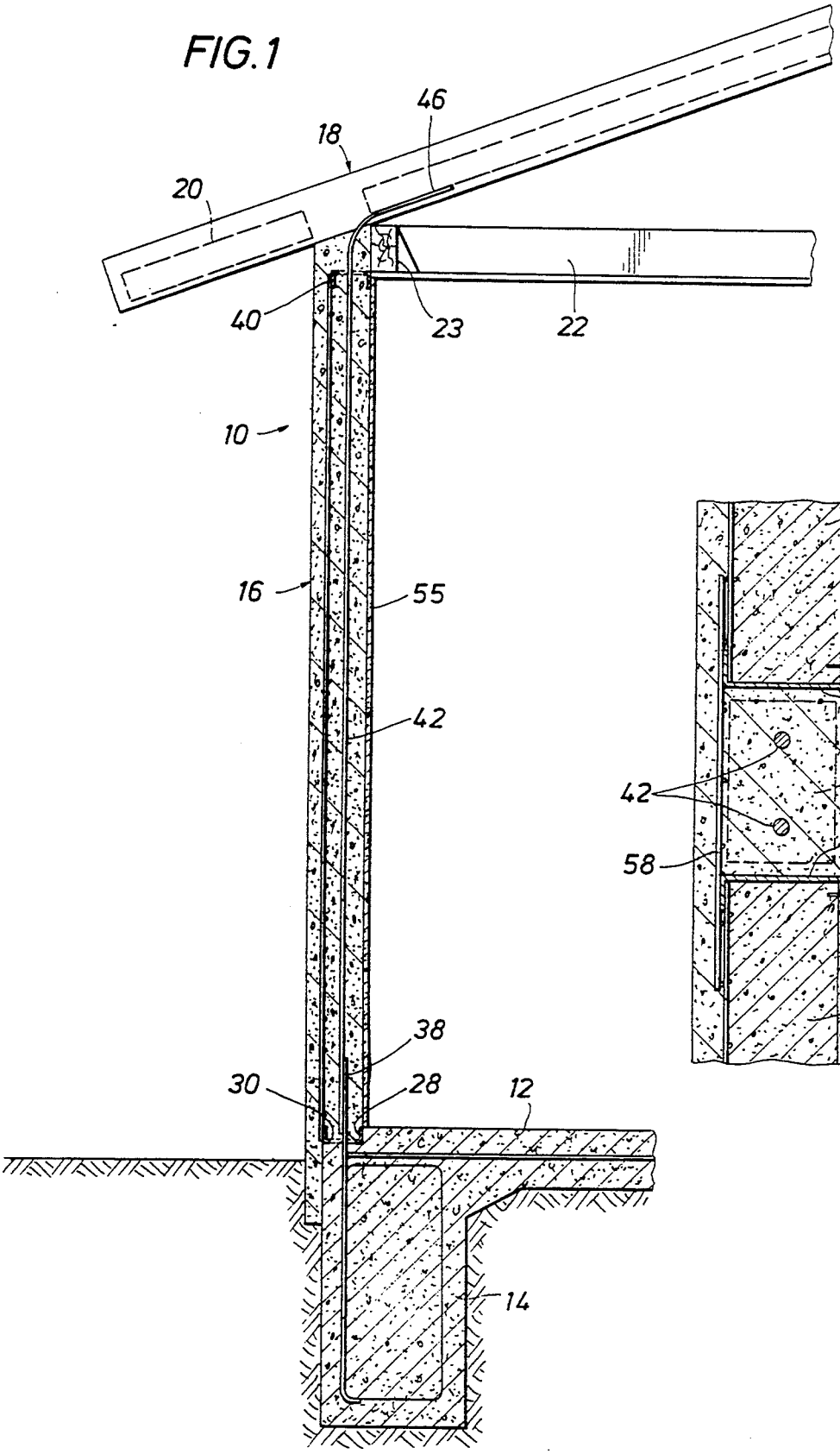
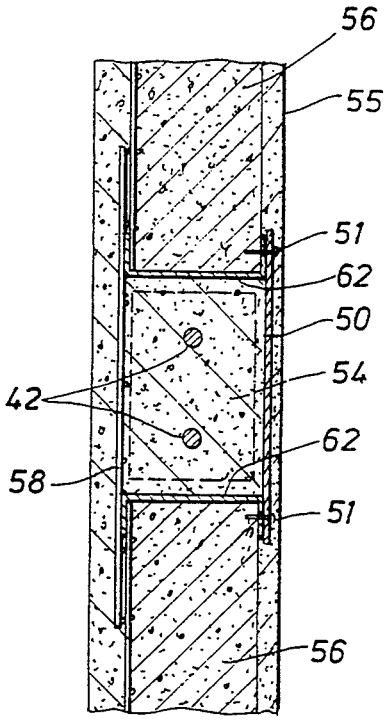
FIG. 3

CONCRETE WALLS FOR BUILDINGS AND METHOD OF FORMING

FIELD OF THE INVENTION

This invention relates to concrete walls for buildings and the method of forming such concrete walls utilizing a plurality of prefabricated modules which may be constructed offsite and transported to the construction site.

BACKGROUND OF THE INVENTION

Heretofore, such as illustrated in my prior U.S. Pat. Nos. 4,970,838 dated Nov. 20, 1990 and 5,033,248 dated Jul. 23, 1991, prefabricated modules constructed offsite have been utilized for the construction of reinforced concrete walls and buildings. The prefabricated modules included an outer rectangular frame having a layer of insulating material therein, wire mesh material secured to the frame, and an open area for a concrete column to be formed at the construction site upon the pneumatic application of concrete against the modules. Openings are provided in the upper and lower frame members to receive reinforcing bars for the concrete column. The modules are positioned in side-by-side relation at the construction site and secured to a concrete slab or foundation. Thus, the prefabricated modules are formed particularly for securing the concrete column within the module frame with an open space adjacent the insulation panel for the concrete column formed at the construction site.

Additionally, the prefabricated modules shown in the aforementioned patents require the fastening of four longitudinal members at their ends to form a rectangular frame. With one side of the rectangular frame open, the insulating layer is inserted and then the fourth frame member is installed to close the rectangular frame. The wire mesh material is then installed over the frame and fastened to the frame by separate fasteners. It is time consuming to first connect three frame members together at two corners of the frame, and then connect the fourth frame member at the remaining two corners after insertion of the insulation layer.

SUMMARY OF THE INVENTION

The present invention is particularly directed to a reinforced concrete building construction and method in which vertical walls of the building utilize prefabricated modules for construction of the vertical concrete walls in a minimum of time. The prefabricated module of the present invention includes a rectangular frame for the insulation layer and wire mesh material but no space is provided within the frame for the concrete column. To form the concrete column, two adjacent prefabricated modules are spaced horizontally from each other between upper and lower horizontal support members at the construction site to form a space for the concrete column between adjacent fabricated modules. A backing member spans the space between a pair of adjacent prefabricated modules and is secured to the modules and the support members. Vertical reinforcing bars for the column are mounted in the space between a pair of modules and are secured between a lower concrete foundation and an upper overhead structure for the concrete building. Concrete is pneumatically applied against the backing member and the modules to form the column and to cover the modules for forming the vertical wall.

An improved rectangular frame for the prefabricated module and method of assembly the frame are also provided. The frame includes four longitudinally extending side frame members and four angle shaped preformed corner frame members which are connected to the longitudinally extending side frame members. The insulation layer and wire mesh reinforcing layer may be inserted from an open side within a partially completed frame of two corner members and three side frame members. Then, the remaining side member and two corner members are installed to complete the prefabricated module. Preferably, all of the frame members are channel-shaped in cross section and the side flanges of the frame members retain the wire mesh material and insulation layer within the module without separate fasteners. Thus, the prefabricated module is assembled in a minimum of time with minimal material.

Another feature of this invention is the utilization of a concrete building having continuous reinforced columns spaced at predetermined intervals about the building and secured to a concrete foundation. The continuous reinforced columns are provided between adjacent module sections with each section comprising a roof module secured to two side modules and being of a predetermined width, such as four feet.

It is an object of this invention to provide a concrete wall for a building and method of assembly at a construction site utilizing a plurality of prefabricated modules which may be fabricated offsite at a separate location in a minimum of time with minimal constructional materials.

It is a further object of this invention to provide a concrete building having a continuous reinforced concrete column extending about the building and anchored at its ends to a concrete foundation.

It is an additional object of this invention to provide a method forming a vertical concrete wall utilizing a pair of prefabricated modules spaced from each a sufficient distance to provide a space for a concrete column with concrete pneumatically applied against a connecting backing member between the modules thereof to form the concrete column.

Other objects, features, and advantage of this invention will become more apparent after referring to the following specification and drawings.

BRIEF DESCRIPTION OF THE DRAWINGS

FIG. 1 is a vertical section of a portion of a reinforced concrete building utilizing the improved prefabricated modules of this invention for the vertical wall of the building;

FIG. 3 is an enlarged section along line 3—3 of FIG. 2;

DESCRIPTION OF THE INVENTION

Figure 2:
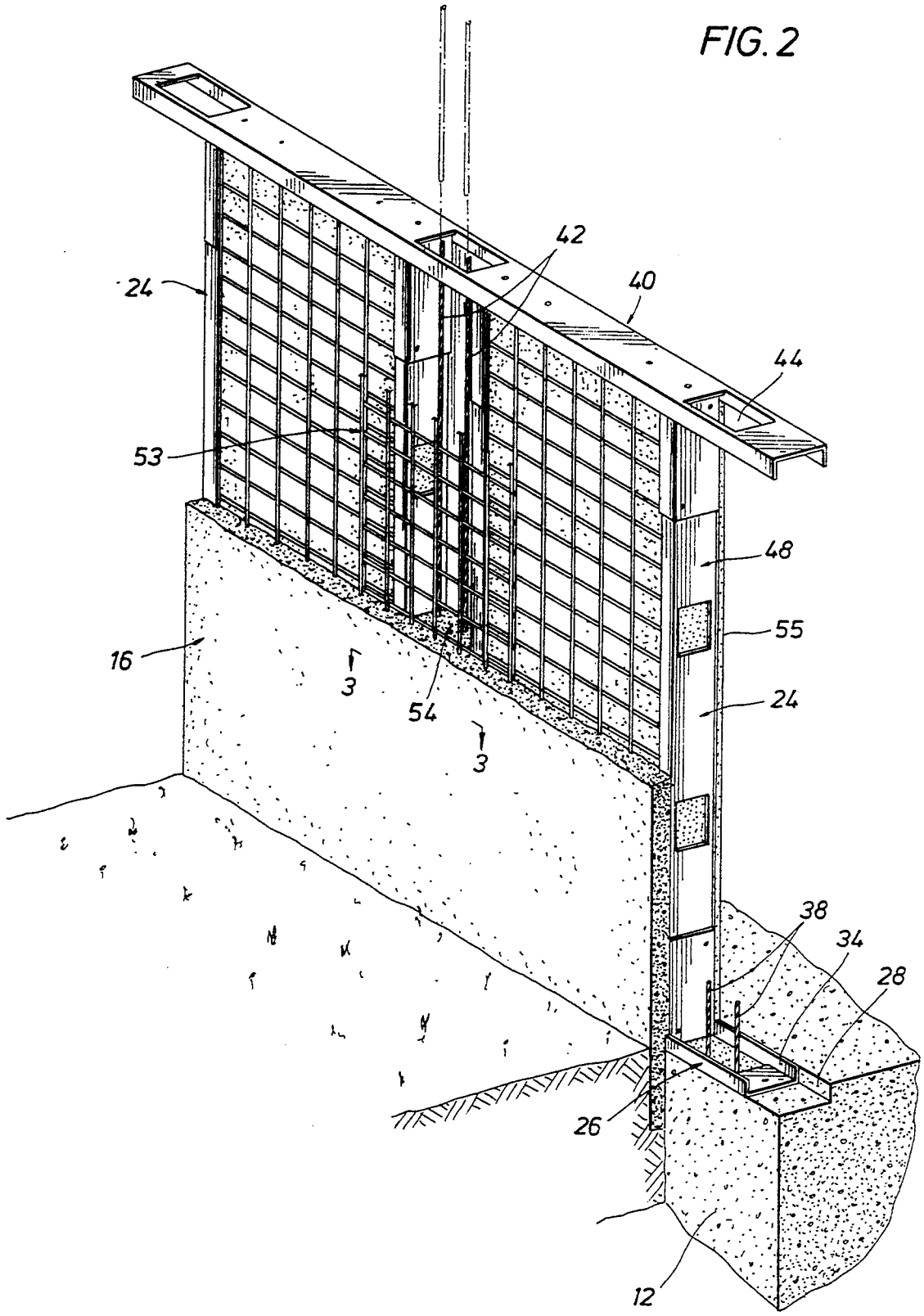
FIG. 2 is a perspective view of a portion of the reinforced concrete building of FIG. 1 showing two spaced modules having a column between the modules with concrete on one side of the module and a drywall panel on the other side, the concrete being broken away to show various members of the modules.

Referring now to FIGS. 1–3, a reinforced concrete building is shown particularly at 10 including a lower concrete floor slab 12 supported by a footing or pier 14 to form the concrete foundation. A vertical wall is shown generally at 16 and a roof is shown generally at 18 including a gable 20. Horizontally extending joists 22 extend between walls of building 10. A wooden nailing member 23 is providing adjacent the outer end of joists 22 at sidewall 16.

Sidewall 16 is formed from a plurality of prefabricated modules illustrated generally at 24 having their lower ends supported on a lower channel-shaped support or track 30 mounted against a ledge 28 of slab 12. Lower support 30 is secured to slab 12 by suitable fasteners 32. Channel-shaped support member 30 has upwardly extending flanges 34 which position modules 24 accurately and restrict modules 24 from lateral movement. Openings 36 are provided in support member 30 and vertically extending dowels 38 anchored to slab 12 are received within openings 36. After lower support member 30 is secured to slab 12, modules 24 which normally have been prefabricated at another location and transported to the construction site are positioned on lower support member 30 between dowels 38. Then, an upper channel-shaped support member 40 is positioned on module 24 in parallel relation to lower support member 30 and secured to module 24 by suitable fasteners 41. Then, overhead joists 22 are secured to upper support 40 for the roof or overhead structure. Reinforcing bars 42 are then secured, such as by welding or wires, to dowels 38 and extend through openings 44 in upper support member 40. Upper end portions 46 of reinforcing bars 42 are bent downwardly for connection to roof 18 as shown particularly in FIG. 1 and prior to the application of concrete.

The space between modules 24 in which dowels 38 and reinforcing bars 42 are positioned provides an area for a concrete column. Each module 24 has an outer rectangular frame generally indicated at 48 and formed of channel-shaped metal frame members connected to each other as will be explained in detail below. A connecting plate 50 forms a backing member for the concrete column and is of a width greater than the width of the open space for overlapping modules 24. Connecting plate 50 is secured by suitable fasteners 51 to metal frames 48 of adjacent modules 24 and to the flanges of support members 30 and 40. Thus, plate 50 also acts as a reinforcing member for the concrete column. An outer wire mesh layer 53 is secured by suitable fasteners such as staples to opposed frames 48 of adjacent modules 24 to provide additional reinforcement for the concrete column.

After installation of support members 30, 40, modules 24, reinforcing bars 42, outer wire mesh layer 53, and backing member 50, concrete 52, such as is applied from a suitable discharge nozzle to the outer surface of modules 24 against backing member 50 to form concrete column 54 between modules 24. The outer concrete surface is screeded to a smooth or rough finish as desired. Then, if desired, a drywall panel 55 as shown in FIG. 1 is secured by suitable fasteners to the inner surface of modules 24 such as to a wooden nailing strip or the like (not shown) provided in the insulation panel. As an example, the width of the space between modules 24 may be eight inches, and connecting plate 50 may be twelve inches in width.

Figure 5:
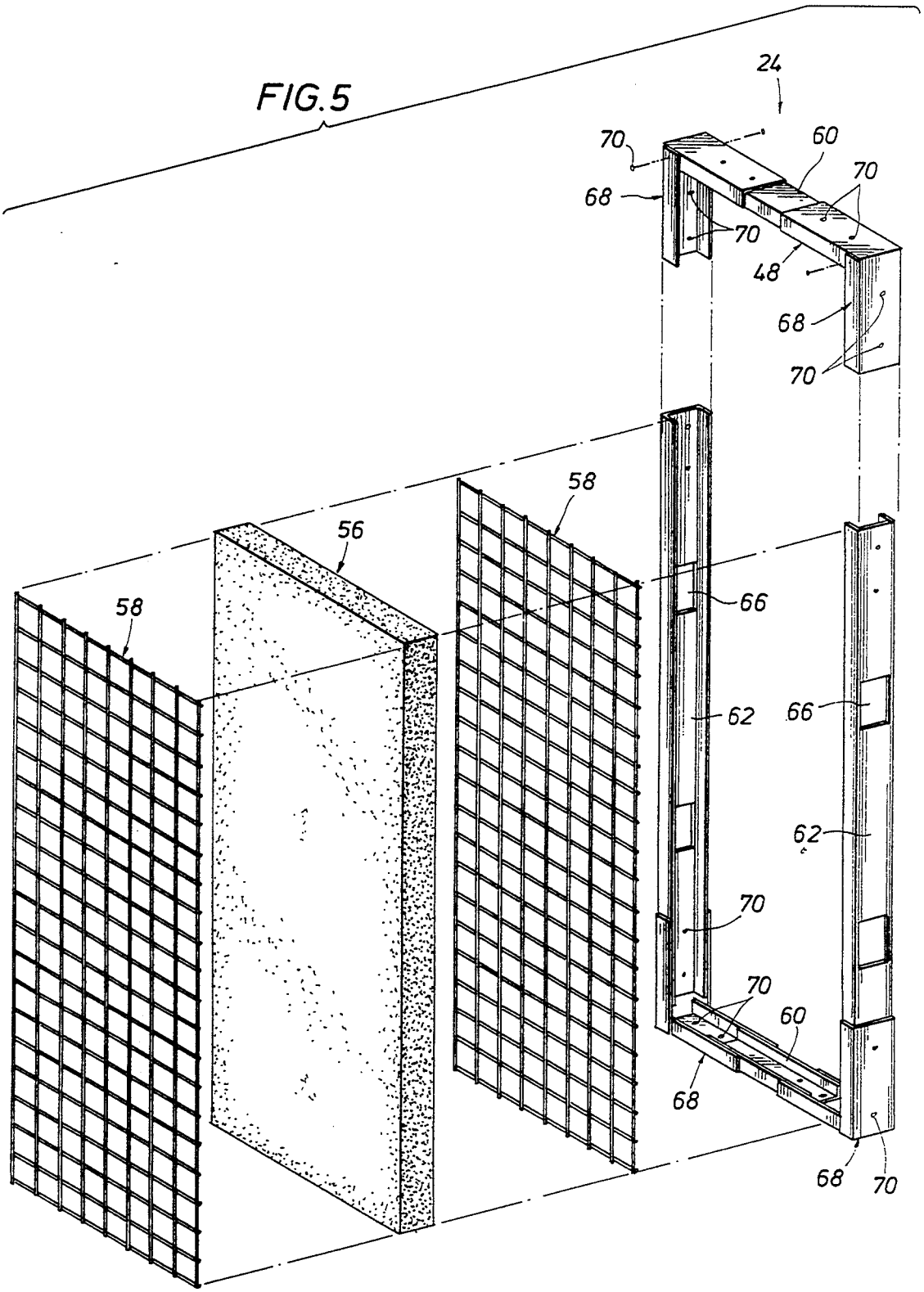
FIG. 5 is an exploded view of a single prefabricated module as shown in FIG. 4 and constructed offsite for shipment or transport to a construction site for installation and construction of the reinforced concrete building as shown in FIGS. 1–3.

Referring now to FIG. 5, prefabricated module 24 is illustrated in exploded relation. Module 24 includes outer metal frame 48, an insulation layer 56 of a rectangular shape, and wire mesh layers 58 of a rectangular shape on opposite sides of insulation layer 56 for reinforcing layer 56. Insulation layer 56 may be formed, for example, from styrofoam or polystyrene. Metal frame 48 includes upper and lower side members 60 and lateral side members 62. Side members 62 have cutouts 66 for the flow of concrete to provide a bond for the concrete column. Corner frame members 68 are preformed and are of an angle shape for fitting over the corners formed by insulating layer 56 and wire mesh layers 58. Side members 60, 62, and corner members 68 are of channel-shape in cross section with the width of corner members 68 greater than the width of side members 60, 62 for receiving members 60, 62 in overlapping relation. Fasteners 70 secure corner members 68 to members 60, 62. While a wire mesh layer 58 has been illustrated on both sides of insulation layer 56, it is to be understood that only a single layer 58 may be provided, if desired.

For assembly of prefabricated module 48, two corner members 68 are assembled to one side member 62 and to both side members 60 leaving one side of frame 48 open. Fasteners 70 are installed when corner members 68 are in desired overlapping relation to extending end portions of side members 60 and 62. Then, insulating layer 56 and wire mesh layers 58 are inserted from the open side of frame 48 within opposed side member 62 and side members 60 with flanges of members 60, 62 retaining layer 56 and wire mesh layers 58 in position. Then, the other side member 62 is fitted over layers 56, 58 and the two remaining corner members 68 are positioned about layers 56, 58 in overlapping relation to channel-shaped side frame members 60 and 62. Fasteners 70 are installed to secure corner members 68 to frame members 60, 62. It may be desirable in some instances to position and secure wire mesh layers 58 to the outer surface of frame 48. Thus, modules 24 may be preformed or assembled at a site remote from the construction site and then transported to the construction site for installation and the application of concrete.

Figure 4:
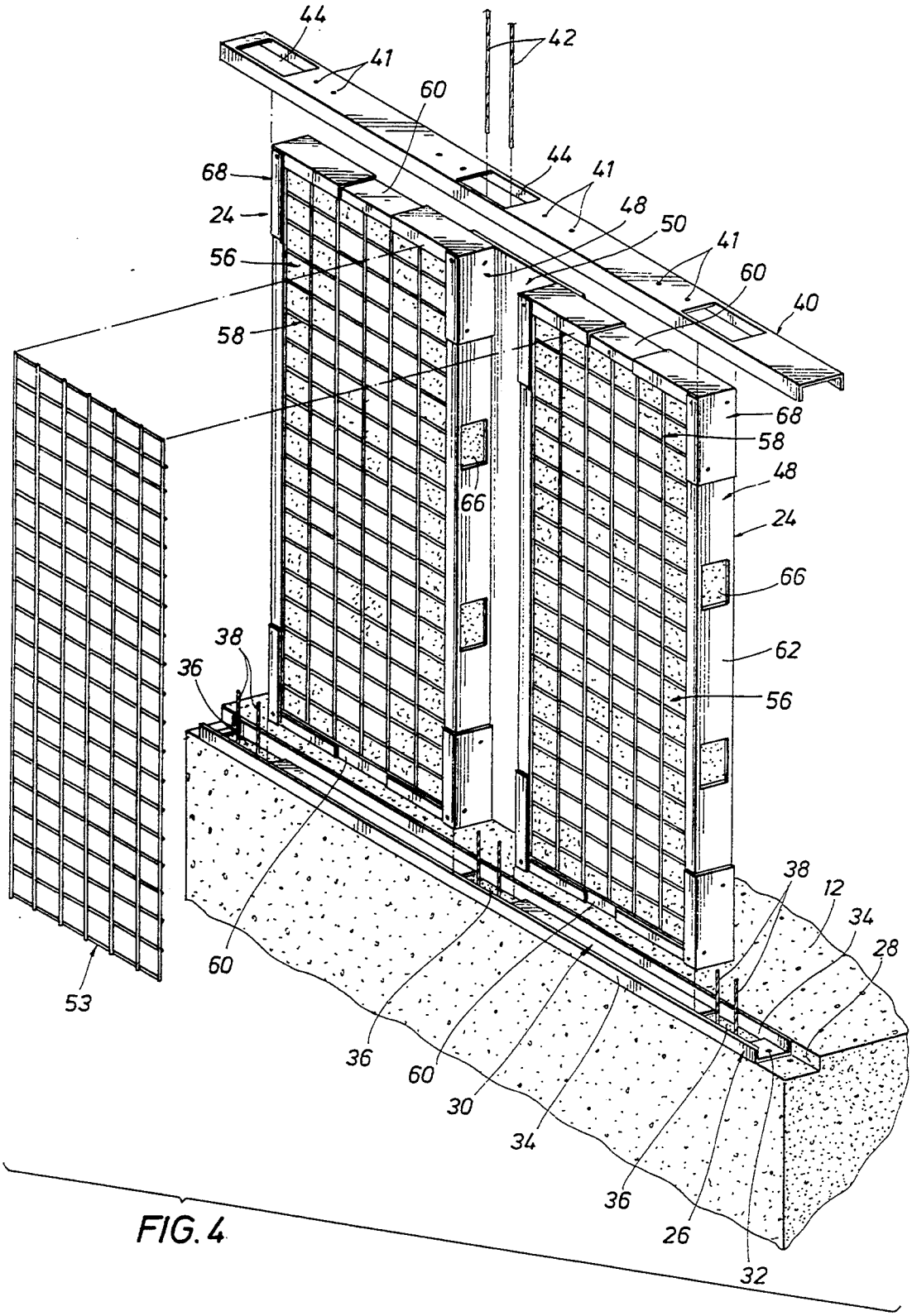
FIG. 4 is an exploded view of the reinforced concrete wall of FIG. 2 showing a pair of modules and the backing member connecting the modules and support members for the modules.

At the construction site as shown in FIGS. 1, 2, and 4, lower support member 30 is secured to concrete slab 12 by fasteners 32 and receive dowel bars 38 through openings 36. Prefabricated modules 24 are positioned on support member 30 between dowel bars 38 to provide a space for concrete column 54 and are secured to support member 30 by fasteners 32. Then, upper support member 40 is mounted over modules 24 and secured to modules 24 by fasteners 41. Next, reinforcing bars 42 are secured to dowel bars 38 and received within openings 44 of upper support member 40. Now, connecting plate 50 is secured to adjacent modules 24 and to support members 30 and 40. In this position, concrete is pneumatically applied against modules 24 and against backing plate 50 to form concrete column 54 between adjacent modules 24 and to form vertical concrete wall 16.

Modules 24, for example, may be of a width of around forty inches and any desired number of modules may be utilized dependent on the length of vertical wall 16.

After the application of concrete which may be of a thickness of around one to two inches outwardly of modules 24, the concrete is screeded to form a uniform outer surface and then finished to a desired finish. Wallboard such as wallboard panels 55 may be applied to the inner surface of the wall. In some instances, it may be desirable to apply concrete pneumatically to the inner surface of modules 24.

Figure 6:
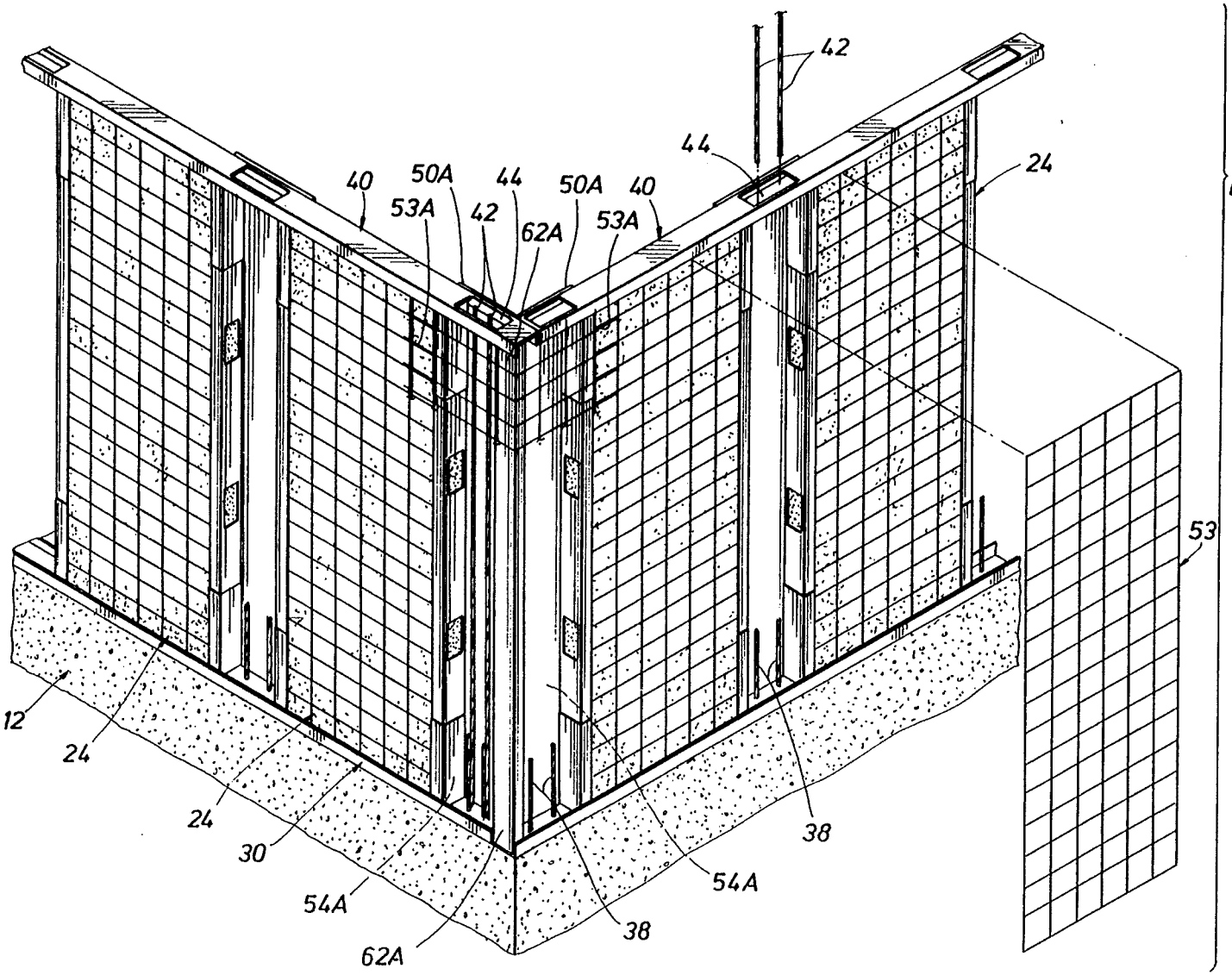
FIG. 6 is a perspective view of a corner of the reinforced concrete building as shown in FIG. 1 illustrating the connection of the modules at the corner.

Referring to FIG. 6, a corner construction for the concrete building of FIGS. 1 and 2 is illustrated and intersecting lower support members 30 and upper support members 40 are secured to inner and outer vertical corner support members 62A of a channel-shape. Lower support members 30 are secured to the concrete slab on foundation 12. Backing plates 50A are secured to inner backing member 62A and support members 30, 40. Reinforcing bars 42 are positioned adjacent backing plates 50A and corner support members 40 and extend through openings 44 in upper support members 40 for securement to the roof as shown in FIG. 1. An outer wire mesh layer 53A for each corner column is secured by suitable fasteners such as staples to outer corner support member 62A and the adjacent module 24 to provide reinforcement for the corner columns formed upon the pneumatic application of concrete.

Figure 7:
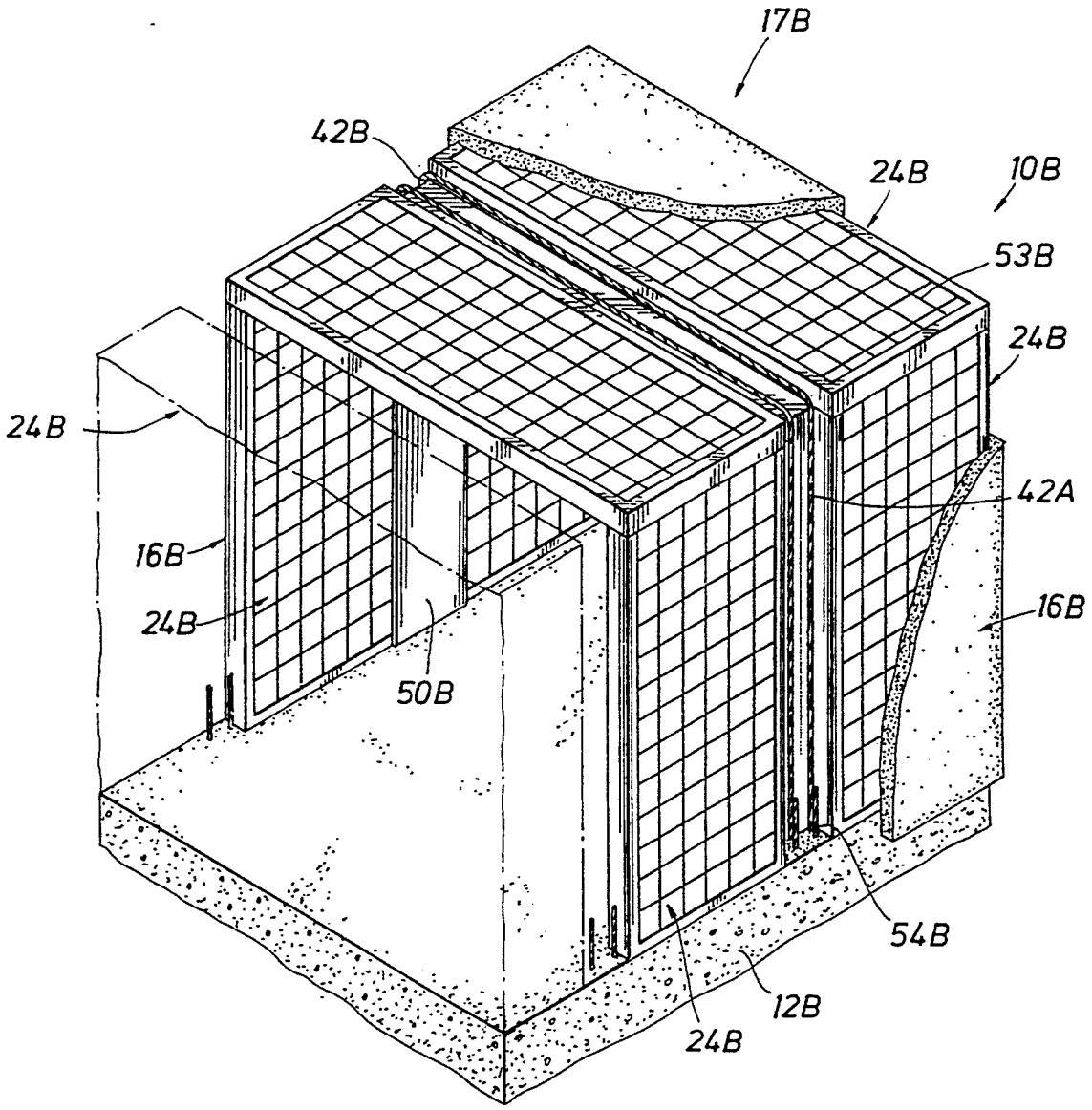
FIG. 7 is a perspective view of another embodiment of a reinforced concrete building illustrating a horizontal roof over vertical walls.

Referring to FIG. 7, a concrete building construction 10B is illustrated including a pair of vertical concrete walls 16B connected by a horizontal concrete roof 17B and supported on foundation 12B. A plurality of module sections forming a channel-shape are positioned in longitudinally spaced relation to each other to form concrete walls 16B and concrete roof 17B. Each module section includes two side modules 24B and a roof module 24B connected to each other to form concrete building 10B of continuous concrete sections connected to concrete foundation 12B. Reinforcing bars 42B are connected to each other in the space between adjacent module sections to form continuous metal reinforcing anchored to foundation 12B. A wire mesh (not shown) is connected over bars 42B to provide additional reinforcement for the concrete column or rib 54B formed between module sections upon the pneumatic application of concrete. A backing or connecting plate 50B is connected between adjacent modules 24B to connect adjacent module sections together. If desired, a lower channel-shaped support (not shown) may be provided similar to the lower support shown in the embodiment of FIG. 4. Modules 24B are similar to the modules shown in FIGS. 4 and 5. Any desired number of module sections each including three modules may be utilized depending on the length of the concrete building. Each module section including two side modules 24B and a connecting roof module 24B may, for example, be of a width of four feet. Concrete is applied pneumatically against modules 24B and an outer layer of concrete outwardly of modules 24B around two to three inches in thickness is provided.

While preferred embodiments of the present invention have been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A method of forming a vertical wall for a concrete building including a plurality of prefabricated modules, said method comprising the following steps:

prefabricating a plurality of generally similar modules for the vertical wall with each prefabricated module having an outer frame of a rectangular shape with a layer of insulation material therein, said outer frame including a pair of spaced parallel side members;

providing a pair of vertically spaced horizontally extending support members for the vertical wall at the construction site to define upper and lower module support members;

placing a pair of said prefabricated modules in a side by side vertical relation between said upper and lower module support members with adjacent side members of said modules spaced horizontally from each other a substantial predetermined distance to form a space for a concrete column;

providing a separate backing member to span the space between said adjacent side members, and securing said backing member to said adjacent side members of the pair of prefabricated modules; and applying concrete from one side of the modules against said modules and against said backing member to cover said modules with concrete and to form a concrete column in the space between said adjacent side members of said modules.

2. The method as set forth in claim 1 further including the steps of:

providing channel-shaped upper and lower support members;

inserting said pair of fabricated modules within said channel shaped lower support members; and placing said channel-shaped upper support member over said fabricated modules.

3. The method as set forth in claim 1 further including the steps of:

providing a concrete foundation for said vertical wall;

securing said lower support member to said foundation; and then mounting said modules on said lower support member.

4. The method as set forth in claim 1 further including the following steps:

forming said rectangular outer frame of said prefabricated modules of channel-shaped metal frame members with flanges of said channel-shaped metal members extending inwardly; and inserting said layer of insulation material from an open side of said module when forming said prefabricated module so that flanges of said channel-shaped frame members retain said layer of insulation material within said module.

5. The method as set forth in claim 1 further including the following steps:

providing a layer of wire mesh reinforcing material for each prefabricated module adjacent said layer of insulation;

forming said rectangular outer frame of said prefabricated modules of channel-shaped frame members with flanges of said channel-shaped members extending inwardly; and inserting said layer of insulation material and said layer of wire mesh reinforcing material from an open side of said module so that flanges of said channel-shaped frame members retain said layer of insulation material and layer of wire mesh reinforcing material within said module.

6. The method as set forth in claim 1 further including the step of:

providing vertical reinforcing bars between said upper and lower support members in the space between said pair of fabricated modules for reinforcing said column upon application of concrete.

7. The method as set forth in claim 7 further including the step of:

securing a wire mesh layer of reinforcing material between said pair of fabricated modules at the construction site in the space for the concrete column to provide additional reinforcement.

8. A method of constructing a concrete building having a concrete foundation, at least two vertical concrete walls, and an overhead structure; said method comprising the steps of:

prefabricating a plurality of generally similar modules for the vertical walls with each prefabricated module having an outer frame of a rectangular shape with an insulation layer therein, said outer frame including a pair of spaced parallel side members;

providing for each vertical concrete wall at the construction site a pair of vertically spaced horizontally extending support members to define upper and lower module supporting members with said lower module supporting member being secured to said concrete foundation;

placing at least a pair of said prefabricated modules in a side by side vertical relation between said upper and lower module support members of each vertical wall with adjacent side members of said pair of modules spaced horizontally from each other a substantial predetermined distance to form a space for a concrete column;

providing a separate backing member to span the space between said adjacent side members, and securing said backing member to said adjacent side members of the pair of prefabricated modules; and applying concrete from one side of the modules against said modules and against said backing member to cover said modules with concrete and to form a concrete column in the space between said adjacent side members of said modules.

9. The method of constructing a concrete building as set forth in claim 8 further comprising the steps of:

forming said rectangular outer frame of said prefabricated modules of channel-shaped metal frame members with flanges of said channel-shaped metal members extending inwardly; and inserting said layer of insulation material from an open side of said modules when fabricating said modules so that flanges of said channel-shaped frame members retain said layer of insulation material within said module.

10. The method of constructing a concrete building as set forth in claim 8 further including the following steps:

providing a layer of wire mesh reinforcing material for each prefabricated module adjacent said layer of insulation when fabricating said module;

forming said rectangular outer frame of said prefabricated modules of channel-shaped frame members with flanges of said channel-shaped members extending inwardly; and inserting said layer of insulation material and said layer of wire mesh reinforcing material from an open side of each module when fabricating said module so that flanges of said channel-shaped frame members retain said layer of insulation material and layer of wire mesh reinforcing material within said module.

11. The method as set forth in claim 8 further including the steps of:

providing vertically extending reinforcing bars extending from said concrete foundation to said overhead structure in the space between adjacent prefabricated modules prior to the application of concrete.

12. The method as set forth in claim 11 wherein the step of applying concrete from one side of the modules includes pneumatically applying concrete from one side of the modules; and then screeding the outer surface of the concrete to provide a predetermined finish to the associated wall.

13. A method of constructing a concrete building having a concrete foundation, at least two vertical concrete walls, and a roof; said method comprising the steps of:

prefabricating a plurality of generally similar modules for the vertical walls with each prefabricated module having an outer rectangular frame of channel-shaped frame members with an insulation layer of a generally rectangular shape therein retained by said frame members, said outer rectangular frame including a pair of spaced parallel side members;

providing for each vertical concrete wall at the construction site a pair of channel-shaped support members extending in a horizontal direction to define upper and lower module support members;

mounting at least a pair of said prefabricated modules in side by side vertical relation between said upper and lower support members with adjacent side members of said pair of modules spaced horizontally from each other a predetermined distance to form a space for a concrete column therebetween;

providing vertically extending reinforcing bars extending from said concrete foundation to said roof through said support members in the space between said adjacent side members of said pair of prefabricated modules prior to the application of concrete; and providing a separate backing member to span the space between said adjacent side members for the application of concrete against said backing member, and securing said backing member to said adjacent side members of the pair of prefabricated modules; and applying concrete from one side of said modules against said modules and within the space between the modules to cover said modules and to form a concrete column in the space between said adjacent side members of said modules.

14. A method of forming a concrete building having at least two generally parallel vertical concrete walls connected by a generally horizontally extending concrete roof and including the following steps:

prefabricating a plurality of generally similar modules for the vertical walls and the roof with each prefabricated module having an outer frame of a rectangular shape with an insulating layer therein, said outer frame including a pair of spaced parallel side members;

providing a concrete foundation for said concrete building;

forming at least a pair of module sections in side by side relation at the construction site with each section including a pair of vertical modules and a connected horizontal module;

spacing adjacent side members of said module sections horizontally from each other a width sufficient for a concrete rib;

securing a seperate inner backing member between adjacent module sections to span the space therebetween and to form a backing for the concrete rib; and applying concrete from an outer side of said module sections and against said backing member to cover said modules with concrete and to fill the space between said adjacent side members of the module sections for forming the connecting concrete rib therebetween.

15. The method as set forth in claim 14 further including the steps of:

providing continuous metal reinforcing adjacent said backing member in the space formed between said pair of module sections; and anchoring said metal reinforcing to said concrete foundation for said concrete building.

16. The method as set forth in claim 14 further including the steps of:

forming said rectangular outer frame of said prefabricated modules of channel-shaped metal frame members with flanges of said channel-shaped metal members extending inwardly; and inserting said layer of insulation material from an open side of said modules when fabricating said modules so that flanges of said channel-shaped frame members retain said layer of insulation material within said module.

* * * * *